US005730197A

United States Patent [19]

Schwingle

[11] Patent Number: 5,730,197

[45] Date of Patent: Mar. 24, 1998

[54] TENSION AND RELEASE MECHANISM FOR BELT MEMBER ON ROLLER DOOR

[75] Inventor: James P. Schwingle, Dickeyville, Wis.

[73] Assignee: Rite-Hite Corporation, Milwaukee, Wis.

[21] Appl. No.: 832,463

[22] Filed: Apr. 2, 1997

Related U.S. Application Data

[63] Continuation of Ser. No. 686,994, Jul. 24, 1996, abandoned.

[51] Int. Cl.[6] ..... E06B 9/17

[52] U.S. Cl. ..... 160/265; 160/322

[58] Field of Search ..... 160/265, 271, 160/273.1, 322, 189, 190, 193; 474/113, 117, 118, 133, 134, 135, 138

[56] References Cited

U.S. PATENT DOCUMENTS

| | | | |
|---|---|---|---|
| 2,406,272 | 8/1946 | Van Vorhees . | |
| 2,588,880 | 3/1952 | Richards | 474/134 X |
| 3,180,401 | 4/1965 | Gambon et al. . | |
| 3,460,602 | 8/1969 | Hugus et al. . | |
| 3,878,879 | 4/1975 | Manns . | |
| 4,252,172 | 2/1981 | Pommat et al. . | |
| 4,476,910 | 10/1984 | Saito . | |
| 4,690,194 | 9/1987 | Seuster . | |
| 4,800,946 | 1/1989 | Rosenoy . | |
| 4,887,660 | 12/1989 | Kraus . | |
| 4,896,714 | 1/1990 | Ellis . | |
| 4,976,302 | 12/1990 | Taylor . | |
| 4,997,022 | 3/1991 | Klein | 160/365 |
| 5,025,847 | 6/1991 | Mueller . | |
| 5,048,588 | 9/1991 | Weishar et al. . | |
| 5,078,197 | 1/1992 | Weishar . | |
| 5,129,442 | 7/1992 | Warner . | |
| 5,139,075 | 8/1992 | Desrochers . | |
| 5,141,044 | 8/1992 | Hying et al. . | |
| 5,222,541 | 6/1993 | Hornberger . | |
| 5,271,448 | 12/1993 | Delgado . | |
| 5,299,617 | 4/1994 | Hying et al. . | |
| 5,353,859 | 10/1994 | Oltahfer et al. . | |

FOREIGN PATENT DOCUMENTS

| | | |
|---|---|---|
| 0 125 217 | 1/1985 | European Pat. Off. . |
| 2 556 403 | 6/1985 | France . |
| 32 45 009 A1 | 6/1984 | Germany . |
| 1 444 017 | 7/1976 | Sweden . |
| 503774 | 4/1939 | United Kingdom . |

OTHER PUBLICATIONS

Overhead Door Jetroll, Form–A–987 Oct. 1995, Copyright Overhead Door Corporation 1995.

Rytec Breaks Away, Copyright Rytec Corpofration 1992.

Albany Rapid Roll Doors, Copyright Albany International 1990.

Kelley Tufflex Beam, Form 20–332, Copyright Kelley Company, Inc. 1993.

Kelley Door Selection Guide, Form 20–287R2, Copyright Kelley Company, Inc. 1993.

*Primary Examiner*—David M. Purol

[57] ABSTRACT

A tension and release mechanism for use on a tension belt, including a first bearing member around which the tension belt passes and which is mounted on a support member. A bias member is coupled to the support member to exert a force on the support member tending to tension the belt. Engagement member is mountable adjacent the support member and is movable to a position wherein it exerts a force on the support member to move the support member to a tension-release position. A latch is also included for latching the support member in the tension release position.

8 Claims, 4 Drawing Sheets

TENSION AND RELEASE MECHANISM FOR BELT MEMBER ON ROLLER DOOR

This is a continuation of application Ser. No. 08/686,994 filed on Jul. 24, 1996 , now abandoned.

FIELD OF THE INVENTION

The present invention is directed generally to industrial doors, and more particularly to a tension release mechanism for a pull-down belt associated with a roller door.

BACKGROUND OF THE INVENTION

Tensioned belts are used in a wide variety of mechanical structures. Often, belting maintained under tension is used for the purpose of transferring power from a motor or other power source to a driven member. An example of the use of such a tensioned belt can be found in certain types of industrial doors. For example, the industrial doors typically referred to as roller doors are comprised of a curtain (typically made of a vinyl fabric) which is wound on a roller disposed either above or beside the doorway with which the door is associated. The roller is driven such that the curtain unwinds from the roller to block the doorway, and winds back up on the roller to unblock the doorway. In the illustratively case, when the roller door is mounted above the doorway opening, a tension belt may be used to assist in closing the door, and/or for the purpose of maintaining tension in the door curtain to provide resistance to billowing in the curtain for wind or pressure differential situations. When a tension belt is used for this purpose, it is typically wound onto and off of a drum fixed to the curtain roller, but wound in a direction opposite to that of the curtain. Thus, as the curtain unrolls, the tension belt rolls onto its drum. The other end of the belt passes around a roller, typically disposed adjacent the bottom of the doorway, and beyond its lateral edge, and is attached to the leading edge of the door. Thus, as the door unrolls and the belt rolls up, the tension belt exerts a downward pulling force on the leading edge of the curtain. Tension is typically maintained on the belt by means of pulleys or rollers which engage the belt at various points along its length, some or all of which may be spring loaded. This ensures that the belt stays under tension and thus always exerts a downward pulling force on the curtain. It will be appreciated by one skilled in the art that such tensioning of the belt may be required to account for differences in radius between the belt winding and unwinding on its drum and the curtain winding and unwinding on its roller. Further, the tension need not be applied to the belt by means of springs, but waits for a variety of other means that may also be used.

It is typically desirable to make the connection between the tensioned belt and the leading edge of the curtain separable for impacts on the door. Accordingly, release or "breakaway" mechanisms between the leading edge of the door and the belt. Most typically, the belt is fixedly attached to a trolley or other member that runs inside of a sideframe disposed on either side of the door, the trolley or other like member having a breakaway connection to the leading edge of the door. Regardless of the nature of the separable or breakaway connection, reattachment of the belt to the leading edge of the door can be problematic in situations where the belt is maintained under tension. This is due to the fact that some or all of the tension on the belt must be overcome to realign the belt to the level of the curtain leading edge for the purpose of attachment. It is thus desirable for the tension belt system to include a mechanism for relieving that tension so that, for breakaway conditions, the belt may more easily be brought into alignment with the leading edge of the curtain so that it can be reattached.

SUMMARY OF THE INVENTION

The tension release mechanism according to the present invention is intended for use primarily in conjunction with a tensioned belt for roller door. It should be noted, however, that the invention is broader in scope, and indeed could be adapted for use on any tensioned belt. The primary object of the invention is to provide a tension release mechanism that is simply to implement and operate and that preferably takes up a minimum amount of space. In addition, it is an object to provide a tension release mechanism that can be locked into its tension release position so that the operator is free to use his hands for other purposes, such as reattaching the belt to the bottom leading edge of the door.

In accordance with these and other objects of the present invention, there is provided a tension release mechanism that includes such advantageous features. The novel tension release includes a first bearing member around which the tensioned belt passes, and which is mounted on a support member, preferably in the form of a rocker arm. Coupled to the support member is a bias member which normally exerts a force on the support member tending to tension the belt. It is the force of this biased member that is relieved through use of the present tension release mechanism. The invention also includes an engagement member mounted adjacent the support member, and movable to a position wherein it exerts a force on the support member in opposition to the force exerted on the support member by the bias member, thus relieving tension on the belt. The invention also comprises a latch for latching the support member in the tension release position. According to the preferred embodiment of the invention, this latch is in the form of a post carried by the engagement member. A toggle is carried by the support member and is movable to a position wherein it engages and latches the post on the engaging member. The latching of the engaging member and the latch member on the support member prevents the support member from returning to the position wherein tension is exerted on the belt. The latch mechanism, of course, is also releasable to allow the supporting member to move back to the biasing position once it is desired to retension the belt.

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents as are included within the spirit and scope of the invention as defined by the appended claims.

Figure 1:
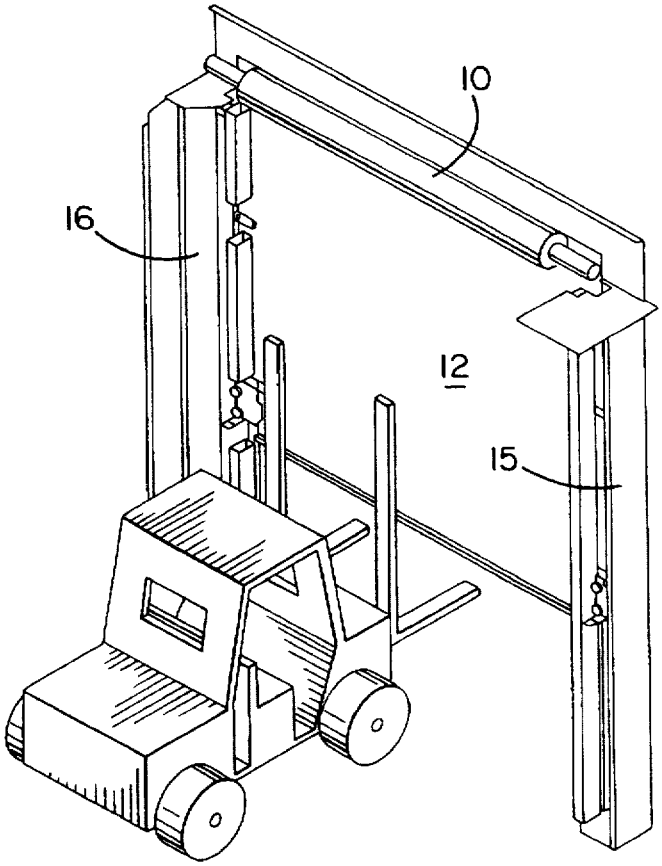
FIG. 1 is an isometric view of a roller door with which the tension and release mechanism according to the invention could be used.
Figure 2:
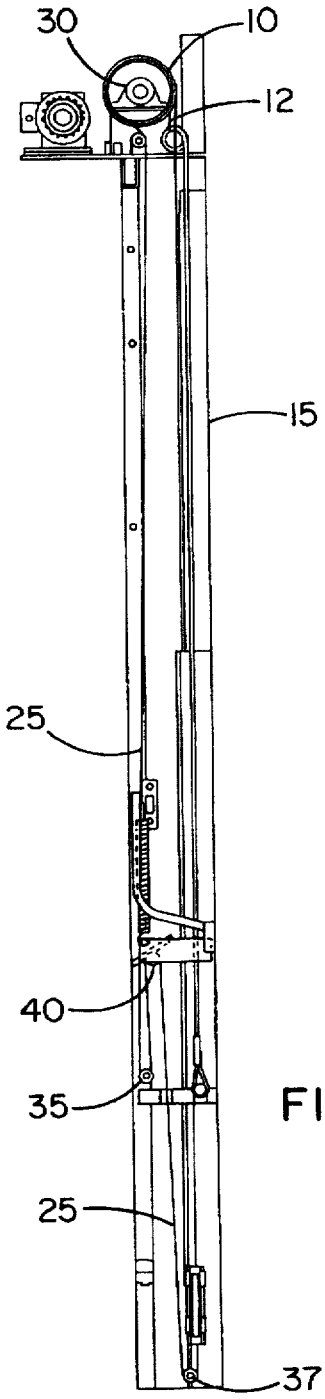
FIG. 2 is a side section view of a typical sideframe for a roller door with which the tension and release mechanism according to the invention could be used.

An illustrative environment in which the tension release mechanism according to the present invention may be used is shown in FIG. 1. FIG. 1 is an isometric view of a roller door showing the roller 10, the curtain 12, and the sideframes 15, 16 disposed on either side of the doorway. Typically, the sideframe is a structure not only for supporting the roller 10, but also for receiving and guiding the lateral edges of the curtain. FIG. 2 is a sectional side elevation one of the sideframes 15, 16 associated with the door of FIG. 1. This sideframe houses a tensioned belt 25 upon which the tension and release mechanism according to the invention may illustratively act. One end of the belt is fixed to a roller 30, which is in turn fixed tothe roller tube 10. Belt 25 winds onto and off of roller 30 in an opposite sense to the direction in which the curtain 12 winds onto and off of the roller 10. The belt then passes over pulleys 35, 37 and 40 and its other end is attached to the leading edge of the door. Thus, as the curtain 12 unrolls from the roller 10, the belt 25 rolls onto the drum 30, thus exerting a pull-down force on the curtain. This pull-down force is enhanced by the tension release mechanism according to the invention.

Figure 3:
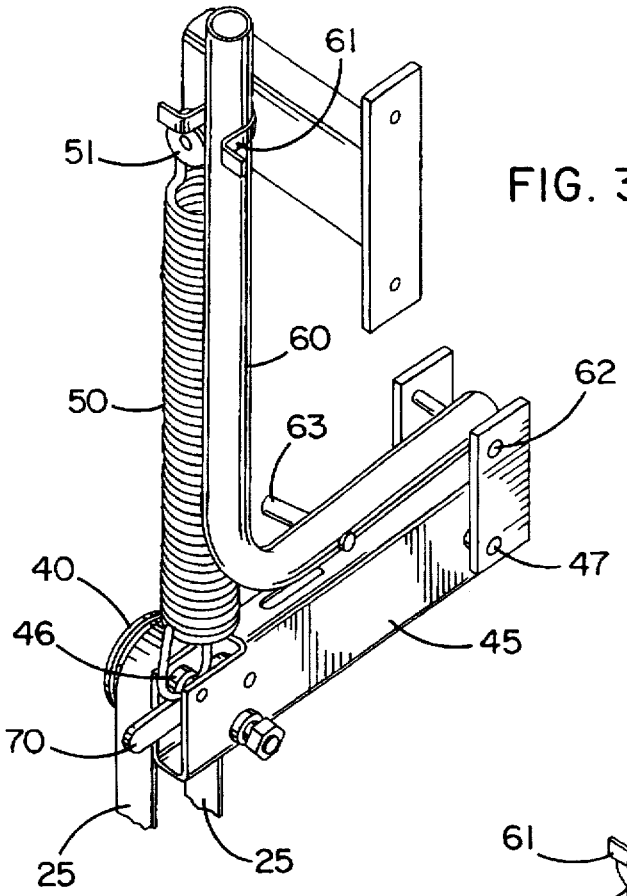
FIGS. 3 and 4 are isometric views of the tension and release mechanism according to the invention shown in tension and tension-release positions, respectively.

The tension and release mechanism is seen most clearly in the isometric view of FIG. 3. It includes a first bearing member illustratively in the form of a roller or pulley 40 around which the belt 25 passes. To tension the belt 25, the roller 40 is mounted on a support member preferably in the form of a rocker arm 45. The rocker arm is mounted to stationary structures, illustratively the sideframe for pivotal movement relative thereto. A bias member in the form of a spring 50 is coupled to the rocker arm 45 to bias it to a position wherein tension is maintained on the belt 25. In the tension and release mechanism of FIG. 3, the spring 50 biases the rocker arm 45 upward, thus ensuring that the belt 25, which passes up and over the roller 40 before going back down, is maintained under tension. In this embodiment, the spring 50 is disposed between a mounting 46 on the rocker arm and a mounting 51 on stationary structure such as the sideframe. However, other structure and position for the bias member is also possible. By way of example only, the bias member could be a torsion spring associated with the pivot axle 47 for the rocker arm. Were such a torsion spring used in the embodiment of FIG. 3, it would tend to rotate the rocker arm 45 in a clockwise direction to maintain tension on the belt 25.

Under certain circumstances, such as when the tensioned belt 25 becomes separated from the leading edge of the curtain, it may be desirable to relieve the tension on the belt. For this purpose, the tension and release mechanism according to the invention also includes an engagement member illustratively in the form of a handle 60 which is mounted adjacent the support member or rocker arm 45. The handle 60 is mounted and disposed such that it is movable between a non-engaged position (wherein it does not exert a force on the rocker arm 45), and a range positions wherein the handle 60 exerts a force on the rocker arm 45 in opposition to the force exerted on the rocker arm by the bias member or spring 50. This, in turn relieves the tension on the belt 25. The range of positions of the rocker arm for which tension in relieved on the belt 25 in this manner will be referred to herein as a range of tension-release positions. The handle 60 is thus disposed and mounted such that it is movable to engage the support member 45, and to move the support member 45 through a range of tension-release positions.

To provide this action in the present embodiment, the handle 60 is pivotally mounted to stationary structure such as the sideframe and is normally held in the non-engaged position by a clip 61. The handle is movable to engage the support member and move it to its range of tension-release positions by rotating the handle about the pivot point 62. A post 63 mounted to the handle engages the top surface of the rocker arm 45, thus pushing the rocker arm in a counterclockwise direction in the sense of FIG. 3. This movement of the handle 60 to engage the rocker arm 45 exerts a force on the bias member 50 in opposition to the bias force normally exerted on the rocker arm 45 by the bias member 50. This opposition force is sufficient to relieve the tension on the belt 25 normally provided by the bias force. As the handle 60 is moved or rotated further, the resulting tension-release effect is greater.

While the handle 60 has been shown as being pivotally mounted to rotate downwardly, the invention is not so limited. Rather, the handle 60 could be mounted in a variety of ways to be capable of exerting a force on the rocker arm 45 tending to oppose the force of the bias member 50. It should be further appreciated that the specific orientation shown for the belt 25, bearing member 40, support member 45, bias member 50 and handle 60 is not intended to be limiting. Rather, a variety of different orientations and specific structures could be used within the scope of the present invention.

Figure 4:
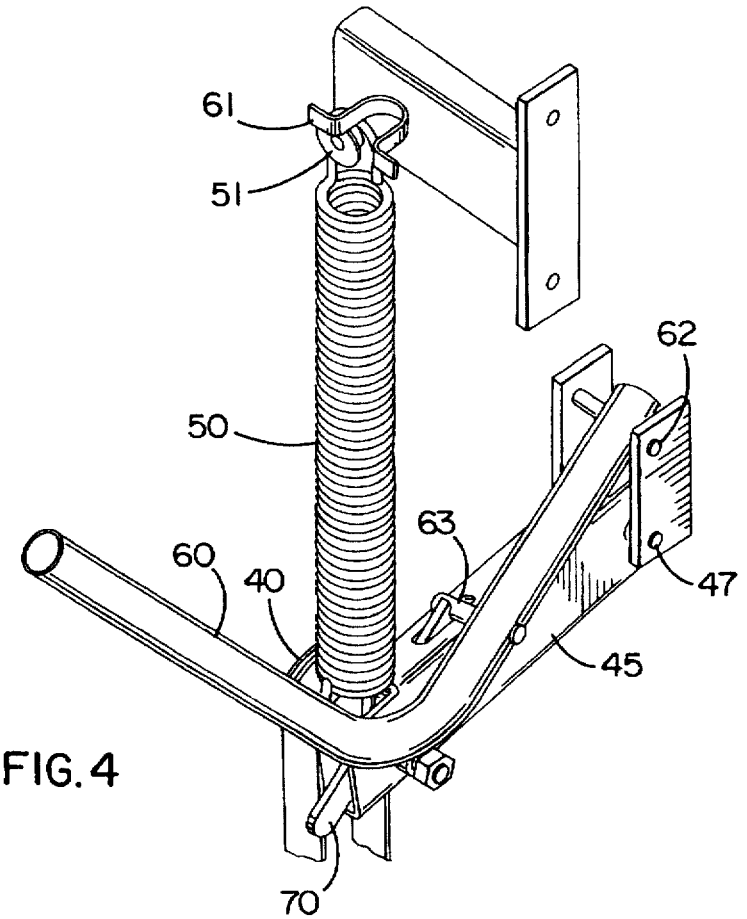
Figure 5:
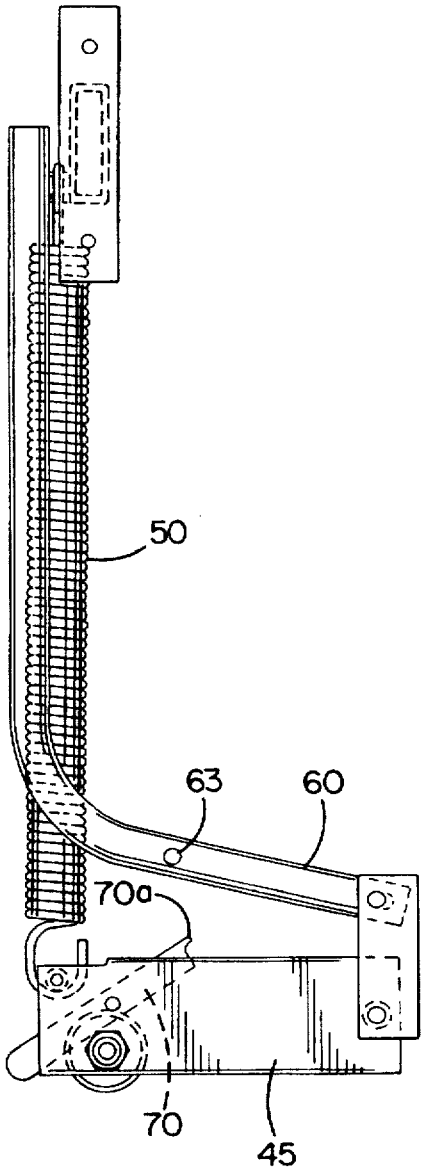
FIGS. 5 through 8 are a series of side elevations of the tension and release mechanism according to the invention, and showing it in various states of operation.
Figure 6:
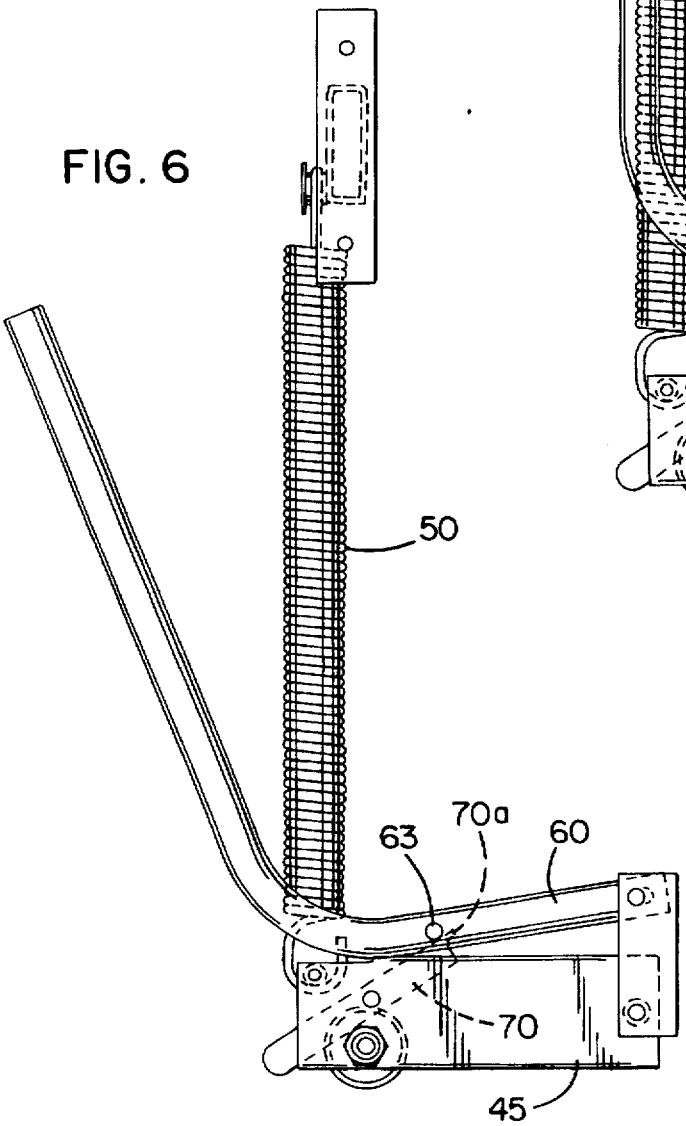
Figure 7:
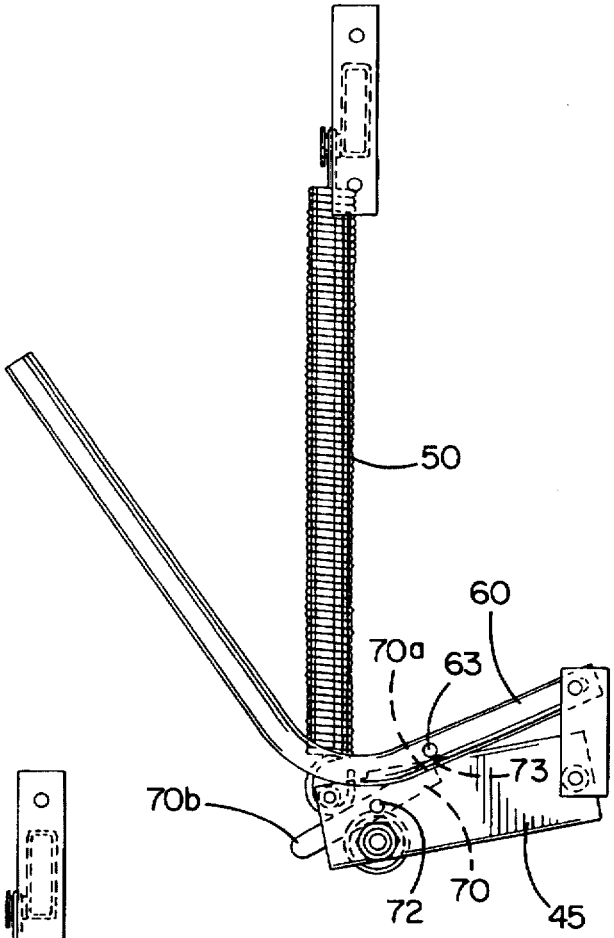
Figure 8:
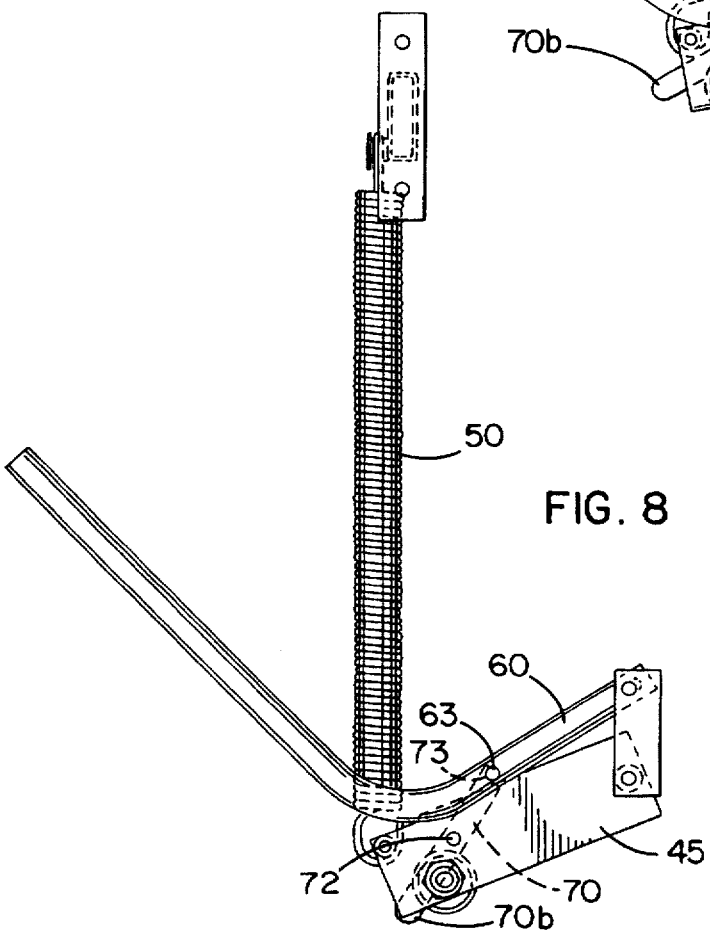

Once the handle 60 has been moved to engage the rocker arm and move it to its range of tension-release positions, it may be useful to be able to secure the support member in such a position, so that a manual force no longer needs to be exerted on the handle 60. This leaves the operator free to use his hands for other purposes, such as reattaching the belt 25 to the curtain 12. Toward that end, the tension and release mechanism according to the present invention includes a latch mechanism for latching the support member in a tension-release position. A toggle member 70 is illustratively pivotally mounted to the support member or rocker arm 45, and is movable relative thereto to a latching position, in which it latches the post 63 on the handle 60, fixing the relative positions of the handle 60, and thus the rocker arm 45 on which the latch member 70 is mounted. As described further below, the toggle member 70 is preferably actuated to move to its latching position by gravity, although other means of actuation could be used. The latching position of the toggle member 70 is shown in FIG. 4. The action of the latch member, and indeed the overall operation of the tension and release mechanism according to the invention is seen more clearly in the elevation views of FIGS. 5–8. FIG. 5 shows the novel tension and release mechanism in its normal operating state when the bias member 50 is exerting a force on the rocker arm 45 tending to tension the belt (not shown). FIG. 6 shows the handle 60 released and in the position in which it first engages the rocker arm 45 to move it to its range of tension-release positions. As can be seen in that drawing, the post 63 on the handle 60 may illustratively first engage the upper surface of the toggle member 70, which is in this embodiment pivotally mounted to the rocker arm 45. FIG. 7 shows the handle 60 further rotated, and thus the rocker arm rotated to a position of greater tension-release. The post 63 on the handle is moving to the right in the sense of the drawing, thus pushing down on the end **70*a* of the toggle member. As the handle moves to the position of FIG. 8, the post 63 passes the end 70*a* of the toggle member. The toggle at this point is biased to rotate counterclockwise by virtue of gravity since its end 70*b* is below its pivot point 72. Thus, once the post 63 moves past the end of the toggle member 70*a*, the toggle member 70 rotates to the latching position of FIG. 8. As is apparent from the figures, and 70***a* of the toggle member includes a detent 73 for receiving the post 63. Once the post 63 has passed the end 70*a*, and once toggle member 70 has moved to the latching position, release of the handle will cause the handle 60 to slide back and engage in the detent in the end 70*a*, since the stored energy in the bias member rotates the rocker arm 45 clockwise in the sense of FIG. 8 until the post 63 engages the detent 73. The mechanism is unlatched by pulling down on the handle 60, thus moving the post 63 forward and disengaging it from the detent 72. The toggle member 70 may then be manually rotated back to a non-latching position, allowing the post 63 to travel unimpeded over the upper surface of the rocker arm 45 until it disengages therefrom.

There has thus been described a new and useful tension and release mechanism for use with a belt, illustratively on a roller door. The mechanism normally exerts a tensioning force on the belt, but also provides for manual release of that tension, and also latches the mechanism in a tension-release position so that the operator may perform other manual tasks associated with the door or other structure with which the tension and release mechanism is associated. The inventive mechanism is simple in operation and provides reliable, repeatable performance.

What is claimed is:

1. A tension and release mechanism for tension belt, the mechanism comprising:

a support member;

a bearing member mounted on the support member and around which the tension belt passes;

a bias member coupled to the support member for exerting the force on the support member tending to tension the belt;

an engagement member mountable adjacent the support member, and movable to a position wherein it exerts a force on the support member to move the support member to a range of tension-release positions wherein tension on the belt is relieved.

2. The tension and release mechanism of claim 1, wherein the support member is a rocker arm pivotally mountable on the stationary structure.

3. The tension and release mechanism of claim 1, wherein the bias member is a spring connected to the support member.

4. The tension and release mechanism of claim 1, wherein the engagement member exerts a force on the support member in opposition to the force exerted on the support member by the bias member when the support member is moved to its tension-release positions.

5. The tension and release mechanism according to claim 1, and including a latch structure for latching the support member to a tension-release position.

6. The tension and release mechanism according to claim 5, wherein the latch mechanism comprises a post carried on the engagement member, and a toggle carried on the support member.

7. The tension and release mechanism according to claim 6, wherein the toggle is movable to a latching position wherein it engages the post on the engagement member.

8. The tension and release mechanism of claim 7, wherein the toggle is gravitational biased toward the locking position when the support member is in a tension-release position.

* * * * *